United States Patent [19]

Kovac

[11] Patent Number: 4,890,730

[45] Date of Patent: Jan. 2, 1990

[54] ELASTIC BAND HOLDER

[76] Inventor: John Kovac, 29 Pheasant Dr., Brick, N.J. 08724

[21] Appl. No.: 210,349

[22] Filed: Jun. 23, 1988

[51] Int. Cl.[4] ..... B65L 75/06; B65D 85/02

[52] U.S. Cl. ..... 206/303; 206/338; 206/495; 206/805

[58] Field of Search ..... 206/805, 338, 340, 303, 206/495

[56] References Cited

U.S. PATENT DOCUMENTS

| | | | |
|---|---|---|---|
| 697,503 | 4/1902 | Lindsay . | |
| 2,012,058 | 8/1935 | Shaw . | |
| 2,328,522 | 8/1943 | Yocum | 206/495 X |
| 3,572,396 | 3/1971 | Hoffman et al. . | |
| 3,858,719 | 1/1975 | Isaacs . | |
| 3,918,132 | 11/1975 | McGahee . | |

*Primary Examiner*—Arnold Rosenthal

[57] ABSTRACT

Apparatus for separately holding a multiplicity of each of several different sized elastic bands such as rubber bands. The apparatus includes a body having a multiplicity of storage regions, each of which has a storage slot. Further, the circumferences of at least two of the storage slots in different storage regions are different from one another. More specifically, a storage region is formed by disposing a first storage slot having a first circumference between two other restraining or confining ridges or regions, each of which ridges or regions has a larger circumference than the first region. Different sized elastic bands are then wrapped about the body in the different storage regions. The circumference about the body in a storage slot of a particular storage region which is appropriately sized to hold a particular elastic band is at least as large as the circumference of the inside surface of the elastic band. As such, the elastic band will be stretched and will, thereby, be under tension when it is placed on the body in that storage region.

4 Claims, 2 Drawing Sheets

ELASTIC BAND HOLDER

BACKGROUND OF THE INVENTION

1. Technical Field of the Invention

The present invention pertains to apparatus for holding elastic bands and, in particular, to apparatus for separately holding multiplicities of elastic bands of various sizes.

2. Discussion of the Prior Art

Elastic bands, and rubber bands in particular, are found in many different sizes in a typical home or office. An elastic band is a versatile tool because one elastic band can be used to bind or hold various amounts of various sized articles. In particular, one typically has many elastic and rubber bands of various sizes and one typically stores them in a bundle on a desk or table or in the drawers thereof. Due to the nature of rubber bands, for example, it is difficult to locate and separate out a single rubber band of a particular, desired size from this bundle of various sized rubber bands. This causes inconvenience, consternation and frustration, all of which often leads to anger.

An expedient which is often used to help locate elastic and rubber bands on a desk or table or in a drawer is to collect the bands and to place them into a box or cup. This maintains them in a single place where they can easily be found. However, as the bands are extricated from the box or cup over the course of time or placed into the box or cup, a mess and tangle is created. As a result, when one wants to extricate a particular sized band from the box or cup, because of the tangle in the box or cup, one typically pulls a clump of several bands or the entire contents of the box or cup thereout. Then, one must look through the clump to be able to ascertain which rubber band in the clump, if any, will be of the particular size.

As one can readily appreciate from the above, there exists a need in the art for apparatus for holding a multiplicity of elastic bands and which can separately hold multiplicities of various sized elastic bands.

SUMMARY OF THE INVENTION

Embodiments of the present invention solve the above-described need in the art by advantageously providing apparatus for holding a multiplicity of elastic bands and, in particular, apparatus for separately holding a multiplicity of each of several different sized elastic bands.

Specifically, an embodiment of the present invention comprises a body having a multiplicity of storage regions, each of which has a storage slot. Further, the circumferences of at least two of the storage slots in different storage regions are different from one another. More specifically, a storage region is formed by disposing a first storage slot having a first circumference between two other restraining or confining ridges or regions, each of which ridges or regions has a larger circumference than the first circumference. Different sized elastic bands are then advantageously wrapped about the body in the different storage regions.

The circumference about the body in a storage slot of a particular storage region which is appropriately sized to hold a particular elastic band is preferably at least as large as the circumference of the inside surface of the elastic band. As such, the elastic band will be stretched and will, thereby, be under tension when it is placed on the body in that storage region. In addition, the elastic band must be further stretched to move it over the two, larger circumference, restraining regions surrounding the storage slot in order to place the elastic band therein. The elastic band will then contract when it is stored in the lower circumference storage slot. However, due to the above-described circumference condition, the elastic band will remain confined in the storage region when it is placed in the storage slot. This is because the elastic band must be expanded or stretched to make the circumference of its inside surface large enough for it to be lifted over either of the two adjacent, larger circumference, restraining ridges or regions.

In a preferred embodiment of the present invention, the body is substantially planar and the storage regions comprise slots or indentations disposed on opposing sides of the body. Further, the body may be formed from any material which has sufficient stiffness to prevent substantial distortion which may be caused by the tension produced by the mounted elastic bands. Specifically, the body may be formed from plastic, heavy paper, metal, wood, masonite, and even of wires or metal strips formed so that the outline thereof provides the storage regions described above.

Advantageously, the number of slots or indentations formed in fabricating embodiments of the present invention may be any number. The specific number of slots or indentations used for a particular embodiment depends on the particular user's needs for storing specific numbers of different sized elastic bands. Further, the specific shape, depth and width of the slots for a particular embodiment or whether, in fact, they are the same depend on a particular user's needs. Still further, all of these considerations also apply when embodiments of the present invention are fabricated from metal strips or wire. Yet still further, the arrangement of the storage regions as to whether or not, for example, the regions of successively increasing or decreasing circumferences are disposed in that order on the body are again a design choice. However, in a preferred embodiment, the storage regions are arranged so that the regions of increasing circumference are disposed sequentially in that order.

BRIEF DESCRIPTION OF THE DRAWINGS

The principles of the present invention may be understood by considering the following detailed description together with the accompanying drawing, in which.

To facilitate understanding, identical reference numerals have been used to denote identical elements common to the figures.

DETAILED DESCRIPTION

Figure 1:
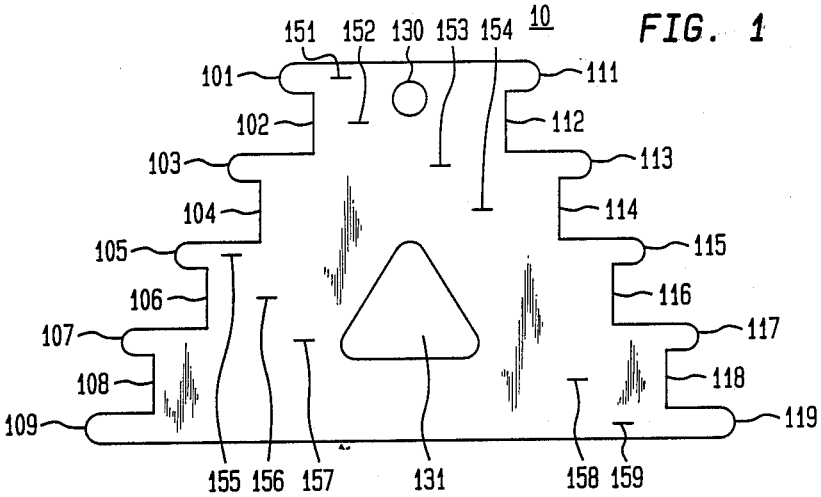
FIG. 1 shows, in pictorial form a first embodiment of the inventive elastic band holder formed from heavy paper such as cardboard.

FIG. 1 shows a first embodiment of the inventive apparatus for holding elastic bands. Body 10 is formed from heavy paper such as cardboard. The paper should be heavy enough so that it does not deform substantially when the elastic bands are stored thereon.

Body 10 is substantially two-dimensional, being essentially planar, and is comprised of a number of regions. Restraining region 151 is defined between protuberances 101 and 111; storage slot 152 is defined between sides 102 and 112; restraining region 153 is defined between protuberances 103 and 113; storage slot 154 is defined between sides 104 and 114; restraining region 155 is defined between protuberances 105 and 115; storage slot 156 is defined between sides 106 and 116; restraining region 157 is defined between protuberances 107 and 117; storage slot 158 is defined between sides 108 and 118; and restraining region 159 is defined between protuberances 109 and 119. The circumference of body 10 about storage slots 152, 154, 156, and 158 is smaller than that around the adjacent restraining regions. Further, although not strictly required by the present invention, storage slots 152, 154, 156, and 158 sequentially have larger circumferences. This may be seen to provide an orderly pattern for storing elastic bands such as rubber bands of increasing size. Also it makes it easy to mount the rubber bands for storage. Still further, body 10 may have an optional hole 130 or cutout 131, or both, for ease of handling or for ease of hanging body 10.

In use, one expands a rubber band and places it about one of storage slots 152, 154, 156 or 158. Preferably one will utilize a region whose circumference is at least as large as, if not larger than, the circumference of the rubber band when it is at rest. In this manner, the rubber band will grip body 10 in the particular storage slot in which it is placed. Further, other rubber bands of various sizes are similarly placed upon body 10 at appropriate regions thereof. As a result, one can readily appreciate that body 10 provides an apparatus for separately holding a multiplicity of rubber bands of various sizes. Advantageously, body 10 may be neatly stored in a desk drawer or hung from a hook on a wall for easy reference. Further, one can insert body 10 by its base, i.e., region 159, into a stand for convenience or appropriate display on a desk. In addition, body 10 can be formed from many other materials than paper. For example, it may be fabricated from wood, metal stiff plastic, masonite, and so forth.

Figure 2:
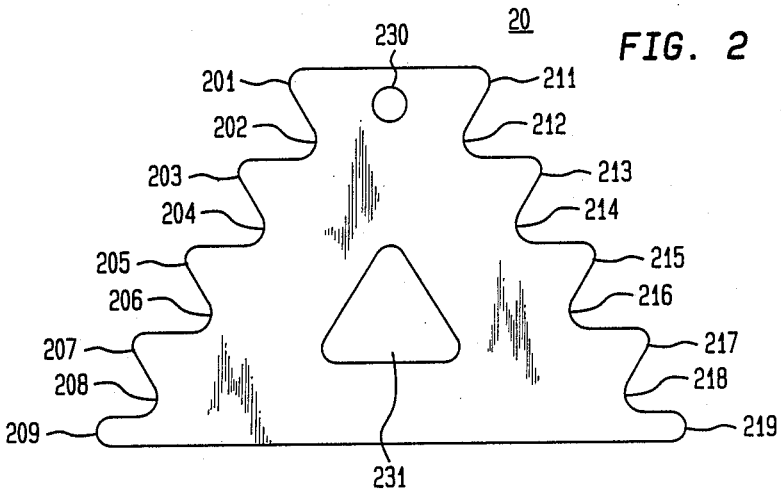
FIG. 2 shows, in pictorial form a second embodiment of the inventive elastic band holder formed from heavy paper such as cardboard.

FIG. 2 shows a second embodiment of the inventive apparatus for holding elastic bands. Body 20 is formed from heavy paper such as cardboard and, as stated above, the paper should be heavy enough so that its does not deform substantially when the elastic bands are stored thereon.

Body 20 is substantially two-dimensional, being essentially planar, and is formed of a number of regions. Restraining region 251 is defined between protuberances 201 and 211; storage slot 252 is defined between sides 202 and 212; restraining region 253 is defined between protuberances 203 and 213; storage slot 254 is defined between sides 204 and 214; restraining region 255 is defined between protuberance 205 and 215; storage slot 256 is defined between sides 206 and 216; restraining region 257 is defined between protuberances 207 and 217; storage slot 258 is defined between sides 208 and 218; and restraining region 259 is defined between protuberances 209 and 219. The circumference of body 20 about storage slots 252, 254, 256 and 258 is smaller than that around the adjacent restraining regions. Further, although not strictly required by the present invention, storage slots 252, 254, 256, and 258 sequentially have larger circumferences. This may be seen to provide an orderly pattern for storing elastic bands such as rubber bands of increasing size. Also it makes it easy to mount the rubber bands for storage. Still further, body 20 may have an optional hole 230 or cutout 231, or both, for ease of handling or for ease of hanging body 20. Storage slots 252, 254, 256, and 258 of body 20 are rounded when compared with storage slots 152, 154, 156, and 158 of body 10 shown in FIG. 1. Nevertheless, they still provide adequate storage slots for elastic bands.

The embodiment shown in FIG. 2 is used in the same manner as described above for the embodiment shown in FIG. 1 to store elastic bands.

Figure 3:
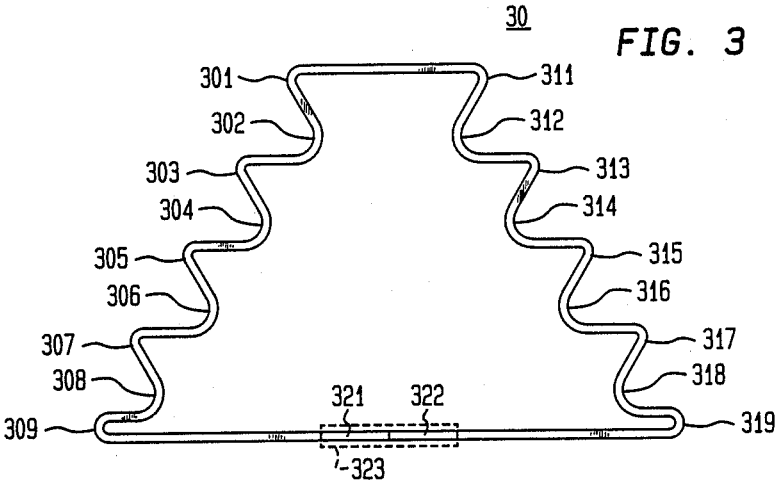
FIG. 3 shows, in pictorial form, a third embodiment of the inventive elastic band holder which is similar to the embodiment shown in FIG. 3 but which is formed from wire.

FIG. 3 shows a third embodiment of the inventive apparatus for holding elastic bands. Body 30 is formed from a metal wire or strip and the wire or strip should be heavy enough so that it does not deform substantially when the elastic bands are stored thereon. Body 30 is substantially two-dimensional, being essentially planar, and is formed of a number of regions. Restraining region 351 is defined between protuberances 301 and 311; storage slot 352 is defined between sides 302 and 312; restraining region 353 is defined between protuberances 303 and 313; storage slot 354 is defined between sides 304 and 314; restraining region 355 is defined between protuberances 305 and 315; storage slot 356 is defined between sides 306 and 316; restraining region 357 is defined between protuberances 307 and 317; storage slot 358 is defined between sides 308 and 318; and restraining region 359 is defined between protuberances 309 and 319. Ends 321 and 322 of the wire or strip which forms body 30 are held together by sleeve 323 which is formed from metal and has been crimped or brazed to hold ends 321 and 322 together. However, ends 321 and 322 may be held together by and one of a number of means well known to those of ordinary skill in the art such as, for example, by welding them together. The circumference of body 30 about storage slots 352, 354, 356, and 358 is smaller than that around the adjacent restraining regions. Further, although not strictly required by the present invention, storage slots 352, 354, 356, and 358 sequentially have larger circumferences. This may be seen to provide an orderly patter for storing elastic bands such as rubber bands of increasing size. Also it makes it easy to mount the rubber bands for storage. Storage slots 352, 354, 356 and 358 of body 30 are similar in form to storage slots 252, 254, 256, and 258 of body 20 shown in FIG. 2.

The embodiment shown in FIG. 3 is used in the same manner as described above for the embodiments shown in FIGS. 1 and 2 to store elastic bands.

Figure 4:
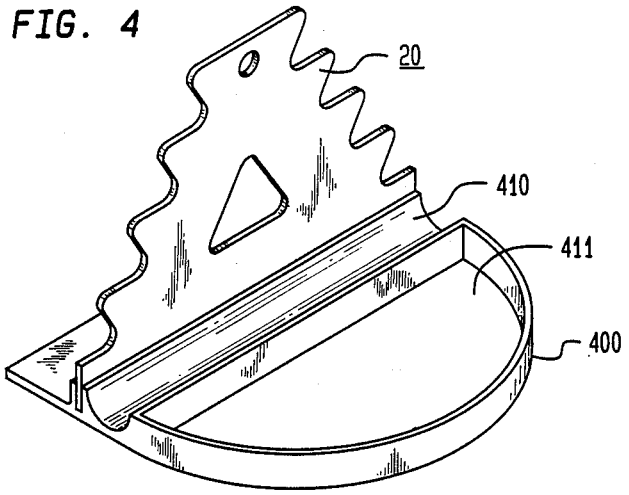
FIG. 4 shows, in pictorial form, an embodiment of the inventive elastic band holder which is placed in a stand.

FIG. 4 shows how embodiment 20 of FIG. 2 may be placed in a stand 400. Stand 400 advantageously may include a pencil through 410 and a paper clip tray 411.

Figure 5:
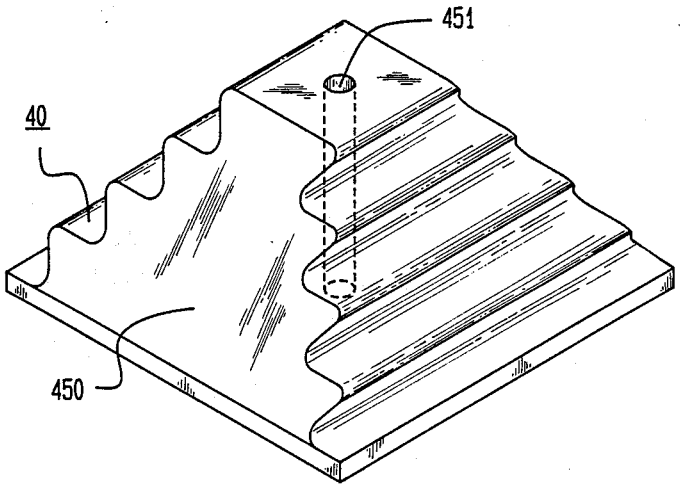
FIG. 5 shows, in pictorial form, a fourth embodiment of the inventive elastic band holder which is substantially three-dimensional.

Although particular embodiments of the present invention have been shown and described herein, many varied embodiments incorporating the teachings of the present invention may be easily constructed by those skilled in the art. For example, although particular embodiments have been shown wherein the bodies are substantially planar, the invention is not limited to substantially two-dimensional bodies. In fact, the invention would operate just as well, as shown by body 40 in FIG. 5, for three-dimensional bodies and may be preferable in certain circumstances where the three-dimensional body also serves as a stand. Note that in the preferred embodiment of a three-dimensional body, portions of the surface thereof, as illustrated by surface 450 in FIG. 5, should be substantially free of indentation in order that one may have a place for using one's fingers to hold onto a rubber band when it is time to remove it. As one can readily appreciate, if at least one portion of the surface were not substantially free of indentation, then it would be hard to reach and retrieve rubber bands from storage slots which have deep recesses. In addition, three-dimensional bodies have a further advantage because the body thereof may serve other purposes such as a stand or to incorporate a pen or pencil holder such as pen or pencil holder 451 shown in FIG. 5.

Still further, although the storage slots of the disclosed embodiments have been shown to be adjacent one another, this is not a requirement of the invention. Yet still further, the body can be partly three-dimensional, which portion also serves as a stand, and partly substantially two-dimensional.

Figure 6:
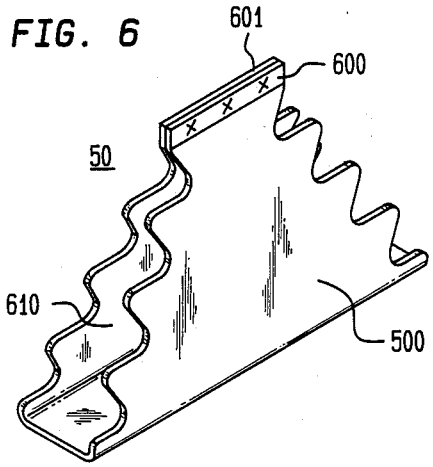
FIG. 6 shows, in pictorial form a fifth embodiment of the inventive elastic band holder which has a substantially three-dimensional outer surface and which is made from a substantially two-dimensional material such as cardboard.

In addition, FIG. 6 shows a further embodiment 50 of the present invention which is formed from a single, substantially two-dimensional material such as cardboard. Cardboard 500 has been fastened together at ends 600 and 601 by glue to form embodiment 50. Ends 600 and 601 may be fastened together by any one of a number of methods well known to those of ordinary skill in the art such as by stapling them together and so forth. Embodiment 50 advantageously has a three-dimensional outer surface and can also stand alone. Further, embodiment 50 is light and easy to manufacture. In addition, one portion of embodiment 50, namely region 610 disposed between the two sides of cardboard 500, is concave and has no slots thereacross. This is advantageous because one may retrieve rubber bands by using the concavity as a place to insert one's fingers when one is reaching to grasp a rubber band.

What is claimed is:

1. Apparatus for holding elastic bands which comprises a body having at least two sections:

one of the at least two sections is comprised of a restraining region and a storage slot, the circumference about the body in the restraining region being greater than the circumference about the body in the storage slot;

another one of the at least two regions is comprised of a restraining region and a storage slot, the circumference about the body in the restraining region being greater than the circumference about the body in the storage slot;

wherein the one of at least two sections is disposed adjacent the another one of the at least two sections so that the storage slot of the one of the at least two sections is disposed adjacent the restraining region of the another one of the at least two sections; and the circumference of the storage slot of the one of the at least two sections is different from that of the storage slot of the another one of the at least two sections;

further, the at least two sections are sequentially disposed so that the circumferences of the second regions of each section decrease from one end of the body to the other;

still further, the body is substantially planar;

yet still further, the body is formed from a material which is substantially resistant to deformation caused by elastic bands stored thereon; and the body is formed from wire.

2. Apparatus for holding elastic bands which comprises a body having at least two sections:

one of the at least two sections is comprised of a restraining region and a storage slot, the circumference about the body in the restraining region being greater than the circumference about the body in the storage slot;

another one of the at least two regions is comprised of a restraining region and a storage slot, the circumference about the body in the restraining region being greater than the circumference about the body in the storage slot;

wherein the one of the at least two sections is disposed adjacent the another one of the at least two sections so that the storage slot of the one of the at least two sections is disposed adjacent the restraining region of the another one of the at least two sections; and the circumference of the storage slot of the one of the at least two sections is different from that of the storage slot of the another one of the at least two sections;

further, the at least two sections are sequentially disposed so that the circumferences of the second regions of each section decrease from one end of the body to the other;

still further, the body is substantially planar;

yet still further, the body is formed from a material which is substantially resistant to deformation caused by elastic bands stored thereon; and the apparatus further comprises a stand which holds the body.

3. Apparatus for holding elastic bands which comprises a body having at least two sections:

one of the at least two sections is comprised of a restraining region and a storage slot, the circumference about the body in the restraining region being greater than the circumference about the body in the storage slot;

another one of the at least two regions is comprised of a restraining region and a storage slot, the circumference about the body in the restraining region being greater than the circumference about the body in the storage slot;

wherein the one of the at least two sections is disposed adjacent the another one of the at least two sections so that the storage slot of the one of the at lest two sections is disposed adjacent the restraining region of the another one of the at least two sections; and the circumference of the storage slot of the one of the at least two sections is different from that of the storage slot of the another one of the at least two sections;

further, the at least two sections are sequentially disposed so that the circumferences of the second regions of each section decreases from one end of the body to the other; and the body is substantially non-planar and at least one portion of the surface thereof is substantially flat, and has no slots across the at least one portion.

4. Apparatus for holding elastic bands which comprises a body having at least two sections:

one of the at least two sections is comprised of a restraining region and a storage slot, the circumference about the body in the restraining region being greater than the circumference about the body in the storage slot;

another one of the at least two regions is comprised of a restraining region and a storage slot, the circumference about the body in the restraining region being greater than the circumference about the body in the storage slot;

wherein the one of the at least two sections is disposed adjacent the another one of the at least two sections so that the storage slot of the one of the at least two sections is disposed adjacent the restraining region of the another one of the at least two sections; and the circumference of the storage slot of the one of the at least two sections is different from that of the storage slot of the another one of the at least two sections;

further, the at least two sections are sequentially disposed so that the circumferences of the second regions of each section decrease from one end of the body to the other; and the body is substantially non-planar and a portion of the body is concave and has no slots across that portion.

* * * * *